US007836698B2

(12) United States Patent
Vandale et al.

(10) Patent No.: US 7,836,698 B2
(45) Date of Patent: Nov. 23, 2010

(54) COMBUSTOR WITH STAGED FUEL PREMIXER

(75) Inventors: Daniel D. Vandale, Greer, SC (US); Girard A. Simons, Greer, SC (US)

(73) Assignee: General Electric Company, Schenectady, NY (US)

( * ) Notice: Subject to any disclaimer, the term of this patent is extended or adjusted under 35 U.S.C. 154(b) by 708 days.

(21) Appl. No.: 11/163,483

(22) Filed: Oct. 20, 2005

(65) Prior Publication Data

US 2007/0089426 A1 Apr. 26, 2007

(51) Int. Cl.
*F02C 1/00* (2006.01)
*F02G 3/00* (2006.01)

(52) U.S. Cl. ..... 60/748; 60/737

(58) Field of Classification Search ..... 60/776, 60/748, 746, 733, 734, 737, 739, 740, 738, 60/777, 723; 239/403, 404
See application file for complete search history.

(56) References Cited

U.S. PATENT DOCUMENTS 4,110,974 A * 9/1978 Herman ..... 60/39.281
5,099,644 A * 3/1992 Sabla et al. ..... 60/207
6,164,055 A 12/2000 Lovett et al. ..... 60/39.06
6,237,343 B1 * 5/2001 Butler ..... 60/723
6,314,717 B1 * 11/2001 Teets et al. ..... 60/804
6,418,726 B1 * 7/2002 Foust et al. ..... 60/776
6,748,745 B2 * 6/2004 Ul Karim et al. ..... 60/777
6,796,130 B2 * 9/2004 Little et al. ..... 60/782
2005/0044842 A1 * 3/2005 Dinu ..... 60/39.11

* cited by examiner

*Primary Examiner*—Michael Cuff
*Assistant Examiner*—Andrew Nguyen
(74) *Attorney, Agent, or Firm*—Sutherland Asbill & Brennan LLP

(57) ABSTRACT

A combustor for mixing a flow of compressed air from a compressor and a flow of fuel from a fuel source. The combustor may include a first swirler for mixing the flow of compressed air and the flow of fuel into a first fuel-air flow, a second flow source for providing a second flow downstream of the first swirler, and a second swirler for mixing the first fuel-air flow and the second flow.

18 Claims, 1 Drawing Sheet

COMBUSTOR WITH STAGED FUEL PREMIXER

TECHNICAL FIELD

The present application relates generally to gas turbine engines and more particularly relates to gas turbine engine combustors with staged fuel injectors and swirlers.

BACKGROUND OF THE INVENTION

Gas turbine engines generally include a compressor for compressing in-coming air. The air is mixed with fuel and ignited in a combustor for generating combustion gases. The combustion gases in turn flow to a turbine. The turbine extracts energy from the gases for driving a shaft. The shaft powers the compressor and generally another load such as an electrical generator.

Exhaust emissions from the combustion gases are a concern and are subject to mandated limits. Certain types of gas turbine engines are designed for low exhaust emissions operation, and in particular, for low NOx (nitrogen oxides) operation, minimal combustion dynamics, and ample auto-ignition and flame holding margins. Low NOx combustors are typically in a form of a number of burner cans circumferentially adjoining each other around the circumference of the engine. Each burner may have a swirler position therein. The swirlers may have a number of circumferentially spaced apart vanes for swirling and mixing the compressed air and fuel as they pass therethrough.

One issue with known gas turbine engines is the need to make the fuel/air mixture as homogenous as possible and the Wobbe index of the fuel/air mixtures as consistent as possible. In the past, the Wobbe index has been controlled with external fuel heating. The issues of the flame holding, auto-ignition margins, and the homogeneous mixing of the fuel and air have been addressed in part by changing the angles on the fuel nozzle swirl vanes and/or by changing the method by which the fuel is introduced to the air or vice versa, i.e., a cross-flow or coaxial flow may be used. The more homogeneous the flow, the more efficient the combustion process may be while producing fewer emissions.

There is a desire, therefore, for a gas turbine engine with improved fuel/air mixing, combustion dynamics, Wobbe control, and flame holding, auto-ignition margin, particularly in the context of low NOx combustion. The improved mixing should be accomplished without loss of engine efficiency.

SUMMARY OF THE INVENTION

The present application thus describes a combustor for mixing a flow of compressed air from a compressor and a flow of fuel from a fuel source. The combustor may include a first swirler for mixing the flow of compressed air and the flow of fuel into a first fuel-air flow, a second flow source for providing a second flow downstream of the first swirler, and a second swirler for mixing the first fuel-air flow and the second flow.

The second flow may include a second flow of fuel and the second flow source may include a fuel injector. The second flow may include a second flow of compressed air and the second flow source may include a source of compressed air. The first fuel-air flow may include an equivalence ratio from about zero (0) to about one-half (0.5) (low) or about one (1.0) to 1.3 (high) and may be a non-combustible mixture. The second fuel-air flow exits the second swirler. The second fuel-air flow may include an equivalence ratio from about one-half (0.5) to about one (1) and may be a combustible mixture.

The present application describes a method of mixing a flow of compressed air from a compressor and a flow of fuel from a fuel source. The method may include mixing the flow of compressed air and the flow of fuel into a first fuel-air flow in a first swirler, adding a second flow downstream of the first swirler, and mixing the first fuel-air flow and the second flow in a second swirler.

The second flow may include a second flow of fuel and/or flow of compressed air. The first fuel-air flow may include an equivalence ratio from about zero (0) to about one-half (0.5) (low) or about one (1.0) to 1.3 (high) and may be a non-combustible mixture. The second fuel-air flow exits the second swirler. The second fuel-air flow may include an equivalence ratio from about one-half (0.5) to about one (1) and may be a combustible mixture.

The present application further describes a gas turbine. The gas turbine may include a compressor and a combustor can positioned downstream of the compressor. The combustor can may include a number of swirlers.

The swirlers may include a first swirler and a second swirler with a flow source positioned between the swirlers. The flow source may include a fuel injector and/or a source of compressed air.

These and other features of the present application will be come apparent to one of ordinary skill in the art upon review of the following detailed description when taken in conjunction with the drawing and the appended claims.

DETAILED DESCRIPTION

Figure 1:
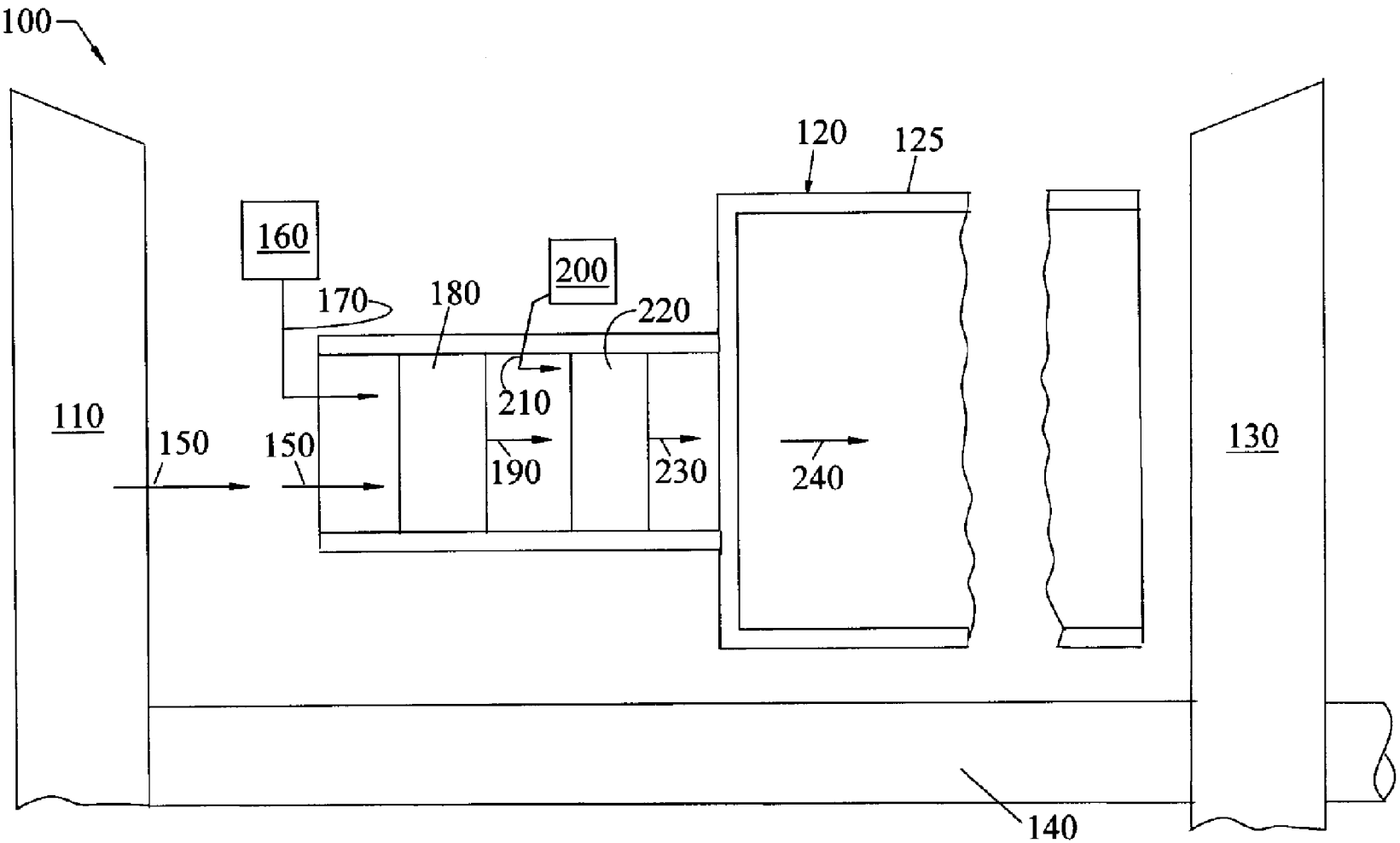
FIG. 1 is a schematic representation of a gas turbine engine as is described herein.

Referring now to the drawing, in which like numerals refer to like elements throughout the view, FIG. 1 shows a turbine engine 100 as is described herein. The turbine engine 100 may include a compressor 110 disposed in serial flow communication with a low NOx combustor 120 and a turbine 130. Other types of combustors 120 may be used herein. The turbine 130 is coupled to the compressor 110 via a driveshaft 140. The driveshaft 140 may extend therefrom for powering an electrical generator (not shown) or other type of external load. During operation, the compressor 110 discharges a compressed air flow 150 into the combustor 120. A fuel injector 160 likewise may deliver a fuel flow 170 to the combustor 110 for mixing therein. The combustor 120 may include a number of combustor cans 125, one of which is shown in FIG. 1.

A first swirler 180 may be positioned within the combustor can 125 downstream of the fuel injector 160 and the compressor 110. As is described above, the first swirler 180 may include a number of spaced apart vanes for swirling the compressed air flow 150 and the fuel flow 170 so as to promote mixing of the flows 150, 170. The first swirler 180 may be of conventional design. A first fuel-air mixture 190 may exit the first swirler 180. Preferably, the first fuel-air mixture 190 may be below the lower flammability range. For example, the first local fuel-air mixture 190 may have an equivalence ratio of about zero (0) to about one-half (0.5). (This is equivalent to a fuel-air ratio of 0.292 assuming the fuel to be 100% methane.) The first fuel-air mixture 190, however, may be fuel rich (non-combustible), combustible, or fuel lean (non-combustible. A ratio above the flammability index would be about 1.0 to about 1.3. The ratio generally may be controlled by the amount of air produced by the compressor 110.

The combustor can 125 also may have a second flow source 200 positioned downstream of the first swirler 180. The second flow source 200 may inject a second flow 210 into the first fuel-air mixture 190. Depending upon the nature of the first fuel-air mixture 190, the second flow source 200 may be a second fuel injector so as to inject a second fuel flow or the second flow source 200 may be a second source of compressed air so to provide a second compressed air flow. The second source of compressed air may include an auxiliary compressor, process air, or similar sources. Injecting a second compressed air flow may impact the lower heating value of the flows entering the turbine 130. Alternatively, a second fuel injector and a second source of compressed air both may be used.

The combustor can 125 may have a second swirler 220 positioned downstream of the second fuel source 200. The first fuel-air mixture 190 and the second flow 210 may be swirled and mixed within the second swirler 220. The configuration of the second swirler 220 may be similar to the first swirler 180. A second fuel-air mixture 230 may exit the second swirler 220. The second fuel-air mixture 230 will be within the flammability range. The second fuel-air mixture 230 may have an equivalence ratio of about one-half (0.5) to about one (1).

Although the use of two (2) swirlers 180, 220 is shown, any number of swirlers 180, 200 may be used herein. Additional fuel or air injections also may be used.

The second-fuel air mixture 230 may be ignited for generating combustion gases 240. As described above, the energy from the combustion gases 240 is extracted by the turbine 130 for rotating the shaft 140 so as to power the compressor 110 as well as producing output power for driving the generator or other type of external load.

The use of the first and second swirlers 180, 220 thus provides for a more homogenous second fuel-air mixture 230. As a result, the turbine engine 100 may produce overall lower emissions while being more efficient. For example, the turbine engine 100 may produce NOx emissions between about 9 ppm ("parts per million") and about 25 ppm (corrected to 15% $O_2$) when operating at about 35% simple cycle efficiency over a given period of time. Carbon monoxide and other types of emissions also may be reduced.

It should be apparent that the foregoing relates only to the preferred embodiments of the present application and that numerous changes and modifications may be made herein without departing from the general spirit and scope of the invention as defined by the following claims and the equivalents thereof.

What is claimed is:

1. A combustor system, comprising:

a flow of compressed air produced by a compressor;

a flow of fuel produced by a fuel source;

a first swirler in communication with both the flow of compressed air and the flow of fuel for mixing the flow of compressed air and the flow of fuel into a first non-combustible, non-flammable fuel-air flow;

a second flow produced by a second flow source downstream of the first swirler; and a second swirler in direct communication with both the first non-combustible, non-flammable fuel-air flow and the second flow for mixing the first non-combustible, non-flammable fuel-air flow and the second flow.

2. The combustor system of claim 1, wherein the second flow comprises a second flow of fuel.

3. The combustor system of claim 2, wherein the second flow source comprises a fuel injector.

4. The combustor system of claim 1, wherein the second flow comprises a second flow of compressed air.

5. The combustor system of claim 4, wherein the second flow source comprises a source of compressed air.

6. The combustor system of claim 1, wherein the first non-combustible fuel-air flow comprises an equivalence ratio of about zero (0) to about one-half (0.5).

7. The combustor system of claim 1, wherein the first non-combustible fuel-air flow comprises an equivalence ratio of about one (1) to about 1.3.

8. The combustor system of claim 1, wherein a second fuel-air flow exits the second swirler and wherein the second fuel-air flow comprises an equivalence ratio of about one-half (0.5) to about one (1).

9. The combustor system of claim 8, wherein the second fuel-air flow comprises a combustible mixture.

10. A method of mixing a flow of compressed air from a compressor and a flow of fuel from a fuel source, comprising:

mixing both the flow of compressed air and the flow of fuel into a first non-combustible, non-flammable fuel-air flow in a first swirler, wherein the first swirler is in communication with both the flow of compressed air and the flow of fuel;

adding a second flow downstream of the first swirler; and mixing directly the first non-combustible, non-flammable fuel-air flow and the second flow in a second swirler, and wherein the second swirler is in direct communication with both the first non-combustible, non-flammable fuel-air flow and the second flow.

11. The method of claim 10, wherein the second flow comprises a second flow of fuel.

12. The method of claim 10, wherein the second flow comprises a second flow of compressed air.

13. The method of claim 10, wherein the first non-combustible fuel-air flow comprises an equivalence ratio of about zero (0) to about one-half (0.5).

14. The method of claim 10, wherein the first non-combustible fuel-air flow comprises an equivalence ratio of about one (1.0) to about 1.3.

15. The method of claim 10, wherein a second fuel-air flow exits the second swirler and wherein the second fuel-air flow comprises an equivalence ratio of about one-half (0.5) to about one (1).

16. The method of claim 15, wherein the second fuel-air flow comprises a combustible mixture.

17. The combustor system of claim 1, wherein the second swirler mixes the first non-combustible fuel-air flow and the second flow to create a second non-combustible fuel-air flow.

18. The combustor system of claim 17, wherein the second non-combustible fuel-air flow comprises a homogeneous fuel-air flow.

* * * * *